US005938863A

United States Patent [19]

Malley

[11] Patent Number: 5,938,863

[45] Date of Patent: Aug. 17, 1999

[54] LOW CYCLE FATIGUE STRENGTH NICKEL BASE SUPERALLOYS

[75] Inventor: David R. Malley, Bolton, Conn.

[73] Assignee: United Technologies Corporation, Hartford, Conn.

[21] Appl. No.: 08/767,664

[22] Filed: Dec. 17, 1996

[51] Int. Cl.[6] ..... C22C 19/05; C22F 1/10

[52] U.S. Cl. ..... 148/428; 148/556; 148/677; 420/448; 428/544

[58] Field of Search ..... 420/441, 442, 420/445, 447, 448, 449, 450, 451, 452, 453, 454, 460; 428/544, 668; 148/555, 556, 514, 409, 410, 428, 442, 426, 429, 675, 677, 676

[56] References Cited

U.S. PATENT DOCUMENTS

| | | | |
|---|---|---|---|
| Re. 29,920 | 2/1979 | Baldwin | 75/134 |
| 2,977,222 | 3/1961 | Bieber | 75/171 |
| 3,667,938 | 6/1972 | Boesch | 75/171 |
| 4,078,951 | 3/1978 | Denzine et al. | 148/32.5 |
| 4,083,734 | 4/1978 | Boesch | 148/32.5 |
| 4,488,915 | 12/1984 | Hill et al. | 148/404 |
| 4,574,015 | 3/1986 | Genereux et al. | 148/11.5 |
| 5,120,373 | 6/1992 | Miller et al. | 148/564 |
| 5,328,659 | 7/1994 | Tillman et al. | 420/448 |
| 5,395,584 | 3/1995 | Berger et al. | 420/443 |
| 5,529,643 | 6/1996 | Yoon et al. | 148/514 |
| 5,556,484 | 9/1996 | Blankenship et al. | 148/211 |
| 5,584,947 | 12/1996 | Raymond et al. | 148/556 |
| 5,584,948 | 12/1996 | Huron | 148/556 |

FOREIGN PATENT DOCUMENTS

| | | |
|---|---|---|
| 0403681 | 12/1990 | European Pat. Off. . |
| 0758684 | 2/1997 | European Pat. Off. . |
| 1511562 | 5/1978 | United Kingdom . |

OTHER PUBLICATIONS

European Search Report dated Apr. 22, 1998.

Shields Jr. J.A., Molybdenum and Its Alloys, Advanced Materials & Processes Oct. 1992, 7 pgs.

*Primary Examiner*—John J. Zimmerman
*Assistant Examiner*—Michael LaVilla
*Attorney, Agent, or Firm*—John E. Boyd, Esq.; Whitman Breed Abbott & Morgan LLP

[57] ABSTRACT

A high strength nickel base superalloy article having a machined surface is disclosed. The superalloy comprises, in weight percent, 1.2–3.5 Al, 3.0–7.0 Ti, 12.0–20.0 Cr, 2.0–3.9 Mo, 10.0–20.0 Co, 0–4.5 W, 0.005–0.025 C, 0.005–0.05 B, 0.01–0.1 Zr, 0–0.005 Mg, 0–1.0 Ta, 0–1.0 Nb, 0–2.0 Fe, 0–0.3 Hf, 0–0.02 Y, 0–0.1 V, 0–1.0 Re, balance essentially Ni. The superalloy further comprises a plurality of discrete carbides essentially free from molybdenum for increased fatigue strength.

40 Claims, 1 Drawing Sheet

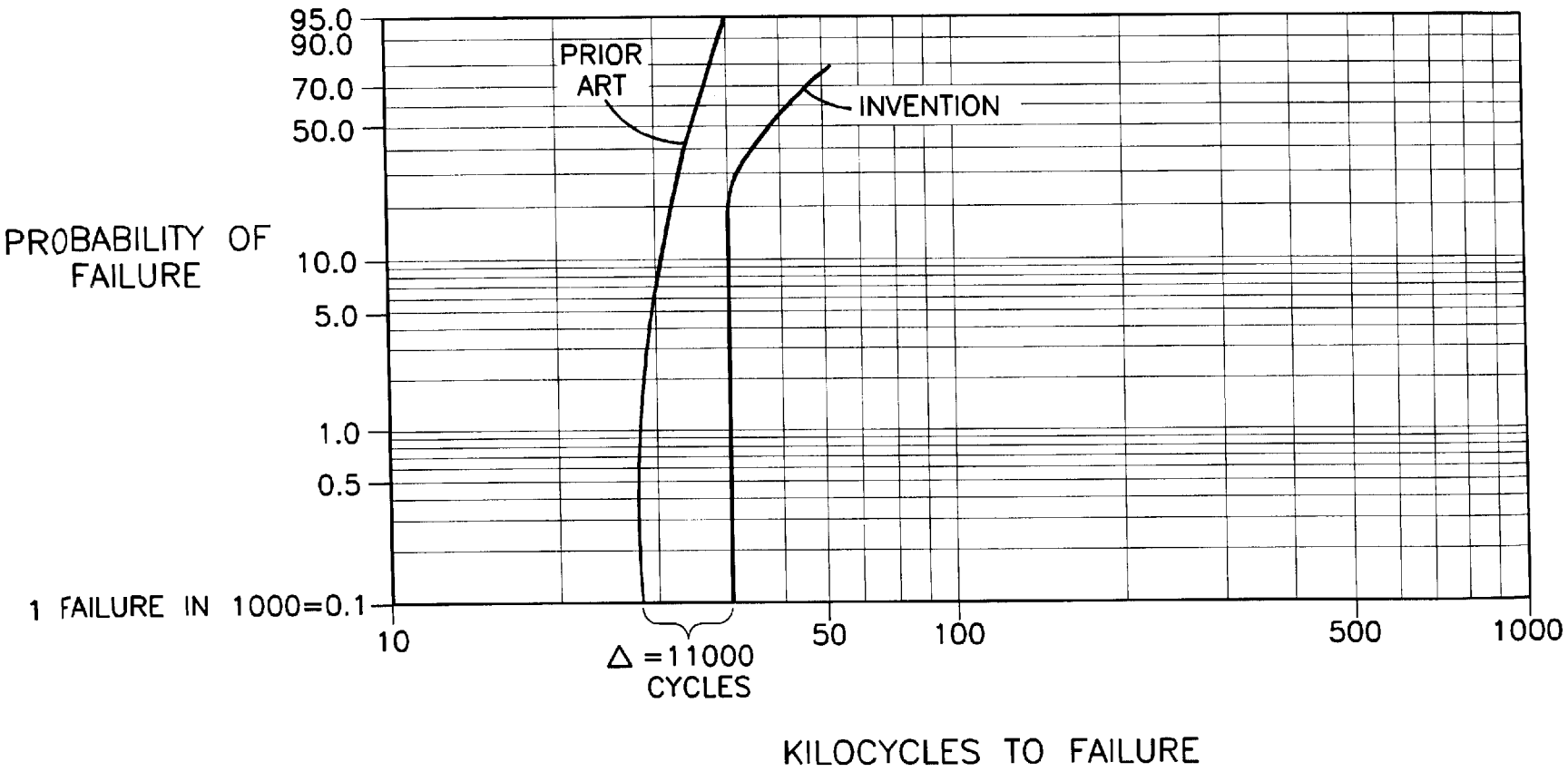
PROBABILITY OF FAILURE
95.0
90.0
70.0
50.0
10.0
5.0
1.0
0.5
1 FAILURE IN 1000=0.1
10
50
100
500
1000
KILOCYCLES TO FAILURE
PRIOR ART
INVENTION
Δ =11000 CYCLES

LOW CYCLE FATIGUE STRENGTH NICKEL BASE SUPERALLOYS

TECHNICAL FIELD

The invention relates to nickel base superalloy articles having machined surfaces. The superalloy articles possess superior low cycle fatigue strength and are particularly suited for gas turbine engine components such as shafts, disks, spacers and seals.

BACKGROUND INFORMATION

Nickel base superalloys are commonly employed for gas turbine engine components such as shafts and disks. As a result of the demand for improved performance and efficiency, the components of a modern gas turbine engine operate near the limit of their properties with respect to temperature, stress, and oxidation/corrosion. Due to these aggressive operating environments, the superalloy materials from which the components are made must possess a combination of exceptional properties including high strength capability at elevated temperatures and rotational speeds.

In particular, nickel base superalloy articles suitable for components such as shafts and disks must possess superior low cycle fatigue strength because repeated cycling between full engine power and idle induces a cycle of thermomechanical stress within the engine. Such superalloy articles must possess superior low cycle fatigue strength in order to withstand such conditions.

Superalloy articles for components such as disks are typically machined to bring them to finished geometry. For example, billet material or a forged component may be inserted into a lathe wherein a tool insert removes layers of superalloy material, while the component spins, until the correct geometry or diameter is achieved.

A problem, however, with some prior art machined disks, particularly lathe turned disks using tungsten carbide tool inserts, is that they display low cycle fatigue failures at relatively low lives, under testing conditions.

Accordingly, there exists a need for machined nickel base superalloy articles having superior low cycle fatigue strength.

DISCLOSURE OF THE INVENTION

Applicant has discovered that the low cycle fatigue strength of tungsten carbide turned nickel base superalloy materials suitable for components such as disks (i.e. cast/wrought superalloys) is limited by microstructural damage to the surface and near surface of the superalloy article which occurs during the machining process. For example, during the lathe turning process, the tungsten carbide tool insert damages the primary MC carbides thereby resulting in microstructural and residual stress damage to the surface and near surface of the article. Testing has shown that this microstructural damage is responsible for initiating low cycle fatigue failures at relatively low lives.

MC carbides typically form in the melt when the material is between its solidus and liquidus temperature range. The M stands for one or more types of metal atoms, including but not limited to, titanium and molybdenum; C represents the carbon present in the carbide. The presence of refractory elements such as molybdenum and titanium in combination with carbon lead to the natural occurrence of MC carbides in cast/wrought superalloys. Due to the high temperature of MC carbide formation, these carbides cannot be eliminated or modified through heat treatment practices. A characteristic of the MC carbides is their tendency to be present in linear arrays of individual carbide particles known as carbide stringers after forging. Carbide stringers act to increase the effective size of the individual particles which in turn has a negative impact on low cycle fatigue life properties.

It is therefore an object of the invention to provide a machined surface of a nickel base superalloy article suitable for gas turbine engine components such as shafts and disks wherein the machined surface is not damaged during conventional tungsten carbide lathe turning such that the article of finished geometry possesses superior low cycle fatigue strength.

It is another object of the invention to provide a nickel base superalloy composition which can be fabricated into nickel base superalloy articles such as shafts and disks having machined surfaces which are not damaged during the machining process, wherein the articles possess an exceptional combination of properties, particularly low cycle fatigue strength.

In accordance with the invention, a machined surface of a nickel base superalloy article possessing an exceptional combination of properties, particularly low cycle fatigue strength is disclosed. The broad composition of the nickel base superalloy article is, in weight percent, 1.2–3.5 Al, 3.0–7.0 Ti, 12.0–20.0 Cr, 2.0–3.9 Mo, 10.0–20.0 Co, 0–4.5 W, 0.005–0.025 C, 0.005–0.05B, 0.01–0.1 Zr, 0–0.005 Mg, 0–1.0 Ta, 0–1.0 Nb, 0–2.0 Fe, 0–0.3 Hf, 0–0.02 Y, 0–0.1 V, 0–1.0 Re, balance essentially Ni. An exemplary and preferred composition within the broad range, in weight percent, is about 2.2 Al, about 4.6 Ti, about 15.5 Cr, about 3.0 Mo, about 13.5 Co, about 0.015 C, about 0.015 B, about 0.04 Zr, about 0.001–0.005 Mg, balance essentially Ni. The nickel base superalloy further comprises a plurality of discrete carbides essentially free from molybdenum for increased fatigue strength. The machined surface of the nickel base superalloy article is further characterized by the presence of minimal damage during conventional tungsten carbide lathe turning.

The subject invention is based in part on the following discoveries and observations: Eliminating molybdenum from the carbides of the above superalloy results in significant improvements in low cycle fatigue life because during machining of the superalloy article, particularly during tungsten carbide lathe turning, such molybdenum-free carbides are not excessively damaged and do not cause premature low cycle fatigue failure of the article. Molybdenum's adverse effect on low cycle fatigue strength based on its presence in carbides of wrought superalloys has never before been known or appreciated. This is a significant discovery.

An advantage of the invention is that superalloy articles made therefrom possess excellent low cycle fatigue strength.

Yet another advantage of the invention is that ingots made from the superalloy material of the invention can be fabricated in various size diameters such as diameters greater than or equal to 24 inches thus allowing for the production of large size gas turbine engine hardware such as disks. This is a significant advantage because ingots fabricated from some prior art wrought superalloy materials have a maximum diameter of 20 inches before casting defects occur and thus they cannot be employed for production of large size gas turbine engine hardware.

These and other features, aspects and advantages of the invention will become better understood with reference to the following description, including the accompanying drawings, and appended claims.

BRIEF DESCRIPTION OF THE DRAWINGS

The FIGURE is a Weibull Chart depicting the low cycle fatigue strength of the invention compared to the low cycle fatigue strength of a prior art alloy.

DETAILED DESCRIPTION

In accordance with an embodiment of the invention, a nickel base superalloy article is disclosed. The article possesses an exceptional combination of properties and preferably has a machined surface. The terms "machined surface" herein refer to a surface of an article which has been processed to, for example, a desired shape or geometry; mechanical processing may be employed. Machining processes include, but are not limited to, lathe turning, milling and broaching.

The broad compositional range of the nickel base superalloy article, in weight percent, is 1.2–3.5 Al, 3.0–7.0 Ti, 12.0–20.0 Cr, 2.0–3.9 Mo, 10.0–20.0 Co, 0–4.5 W, 0.005–0.025 C, 0.005–0.05 B, 0.01–0.1 Zr, 0–0.005 Mg, 0–1.0 Ta, 0–1.0 Nb, 0–2.0Fe, 0–0.3 Hf, 0–0.02 Y, 0–0.1 V, 0–1.0 Re, balance essentially Ni. An intermediate range, in weight percent, is 2.0–2.4 Al, 4.45–4.75 Ti, 15.0–17.0 Cr, 2.3–3.7 Mo, 12.0–15.0 Co, 0–0.1 W, 0.010–0.020 C, 0.010–0.020 B, 0.030–0.050 Zr, 0.001–0.005 Mg, 0–1.0 Ta, 0–1.0 Nb, 0–2.0 Fe, 0–0.3 Hf, 0–0.02 Y, 0–0.1 V, 0–1.0 Re, balance essentially Ni. An exemplary and preferred composition within the broad range, in weight percent, is about 2.2 Al, about 4.6 Ti, about 15.5 Cr, about 3.0 Mo, about 13.5 Co, about 0.015 C, about 0.015 B, about 0.04 Zr, about 0.001–0.005 Mg, balance essentially Ni.

Superalloy articles of the invention may be conventionally fabricated. Preferably, the articles are fabricated as follows: A casting of the desired composition is made by vacuum induction melting followed by vacuum arc remelting. The cast material is then preferably processed in accordance with one of two primary schemes or combination thereof, as described in U.S. Pat. No. 5,120,373, which is assigned to the present Assignee and incorporated herein by reference. As described in the '373 patent, according to one scheme, the cast material is deformed at elevated temperatures but below the gamma prime solvus so that gamma prime phase dissolution is minimized or even eliminated. Subsolvus anneals or reheat treatments may be employed to maintain billet temperature, affect recrystallization, while avoiding or minimizing gamma prime phase dissolution. In addition, super-solvus anneals or reheat treatments may be employed to produce extensive or complete gamma prime phase dissolution in conjunction with extensive or complete recrystalization. The total amount of work required will be equivalent to that required to produce at least 0.5 and preferably at least 0.9 cumulative true strain. This cumulative true strain may be obtained from combined hot deformation operations including upsetting and drawing. During upsetting an average strain rate of at least about 0.1 in/in/min. is preferred. During drawing an average strain rate of at least about 0.5/in/in/min. is preferred. To perform this amount of work on a cast superalloy material at a temperature below the gamma prime solvus, it will undoubtedly be necessary to use multiple deformation steps with intermediate anneals above the gamma prime solvus, to prevent cracking.

As also described in U.S. Pat. No. 5,120,373, the material may alternately be hot worked at a temperature above the gamma prime solvus. It is also possible to accomplish this initial hot working operation using a combination of steps above and below the gamma prime solvus in conjunction with appropriate combinations of intermediate hypersolvus or supersolvus treatments.

After the material has been deformed an amount in excess of 0.5 cumulative true strain, it is given an overage treatment to produce a significantly enlarged gamma prime particle size over that which would normally be present. The resultant microstructure is termed "overaged." The overaging process is similar to that which is described in U.S. Pat. No. 4,574,015, assigned to the present Assignee, the contents of which are herein incorporated by reference. The overaging process consists of cooling the material at a rate of less than about 100° F. and preferably 50° F. per hour, (and most preferably less than 20° F. per hour) through the gamma prime solvus. The resultant coarsened gamma prime particle size will be in excess of 1 micron and preferably in excess of 2 microns.

This overaged material is then further hot deformed an amount in excess of that required to produce a cumulative true strain of 0.9, and preferably a true cumulative strain of at least 1.6. This strain does not include that undergone before the overage treatment. A strain rate of at least about 0.1 in/in/min is employed. This further deformation is accomplished below the gamma prime solvus (but within 200° F.) and without intermediate anneals. Intermediate anneals may be performed at temperatures below but within 200° F. of the gamma prime solvus temperature.

The resultant material, as processed in accordance with the above description, will have an exceptionally fine grain size, predominately finer than ASTM grain size 10 and preferably on the order of ASTM 12 or finer.

Alternatively, an alloy of desired composition may be conventionally processed to have a coarser grain structure, for example, of approximately ASTM 3–7 such as that employed for the commercial alloy known as Waspaloy (nominal composition, in weight percent, of 19.5 Cr, 13.5 Co, 4.2 Mo, 3.0 Ti, 1.4 Al, 0.05 C, 0.007 B, 0.05 Zr, bal Ni).

The volume fraction of gamma prime present in the invention may range between 25–60 percent and preferably between 35–45 percent, depending upon the amount of aluminum and titanium employed in the composition.

The inventive material also includes a plurality of discrete MC carbides. The diameter of the discrete carbides may be between about 0.0005 inches and about 0.0025 inches. Diameters on the order of between about 0.0006 inches and about 0.0007 inches may often be present. The resultant material is further characterized by an absence of carbide stringers.

Applicant has discovered that the composition, size and morphology of the MC carbides have a profound impact on fatigue strength. More specifically, Applicant has discovered how to significantly improve the low cycle fatigue strength of a wrought nickel base superalloy by controlling the amount of molybdenum in the MC carbides such that the MC carbides are essentially free from molybdenum. Molybdenum's adverse effect on low cycle fatigue strength based on its presence in MC carbides of wrought nickel base superalloys has never before been known or appreciated. This is a significant discovery. Specifically, Applicant has determined that by limiting the amount of molybdenum in the superalloy composition to between 2.0 and 3.9 weight percent, and more specifically between 2.3 and 3.7 weight percent, molybdenum free-carbides result. Such molybdenum-free carbides are not excessively damaged during conventional tungsten carbide lathe turning to point of causing premature failure of the article.

Applicant has also determined that in addition to controlling the amount of molybdenum present in the MC carbides, the amount of carbon must also be controlled such that discrete carbides form, as opposed to detrimental carbide stringers. This is possible by controlling the amount of carbon in the superalloy composition to preferably between 0.010 and 0.020 weight percent. As a result of the invention, discrete carbides of carbon and predominantly titanium result.

The invention will be described by way of example which is meant to be exemplary rather than limiting.

EXAMPLE 1

A nickel base superalloy material known as PWA 1113 (nominal composition, in weight percent, of 2.2 Al, 4.6 Ti, 16.3 Cr, 4.2 Mo, 13.5 Co, 0.032 C, 0.006 B, 0.07 Zr, 0.0025 Mg balance Ni) and regarded as among the best prior art high strength, nickel base superalloys used for components such as shafts, seals and disks was processed in accordance with the teachings of U.S. Pat. No. 5,120,373 (also described herein). A preferred composition of the superalloy material of the invention (about 2.2 Al, about 4.6 Ti, about 15.5 Cr, about 3 Mo, about 13.5 Co, about 0.015 C, about 0.015 B, about 0.04 Zr, about 0.0025 Mg, bal Ni) was also processed by method disclosed therein.

The surfaces of the samples were lathe turned using a tungsten carbide tool insert and each sample was subjected to a low cycle fatigue test at 600° F./10 cpm/140 ksi. The results are shown in the FIGURE which is a Weibull Chart depicting probability to failure of the samples vs. kilocycles to failure. As shown in the FIGURE, the invention lasted approximately 11,000 cycles longer than that of the prior art which is regarded as among the best prior art high strength, nickel base superalloys used for components such as shafts, seals and disks. This significant improvement in low cycle fatigue is attributed primarily to the absence of molybdenum in the MC carbides of the inventive machined surface which was not damaged during the lathe turning.

An advantage of the invention is that the operating stress on components fabricated from the invention can be raised approximately five percent while maintaining the same cyclic fatigue life as the prior art alloy. A corresponding reduction in component weight may then also be achieved.

EXAMPLE 2

The preferred superalloy material of the invention, as described in Example 1, was subjected to conventional ultimate tensile strength testing at various temperatures. This material exhibited high strength, as detailed in Table 1 below.

TABLE I

| Temperature (° F.) | Strength (ksi) |
|---|---|
| room temp. | 230 |
| 600 | 220 |
| 900 | 220 |
| 1200 | 200 |

An advantage of the invention is that superalloy articles of the invention comprise a plurality of discrete carbides essentially free from molybdenum for increased fatigue strength. Applicant has discovered that a significant improvement in low cycle fatigue strength can be obtained if molybdenum is essentially eliminated from the carbides. Molybdenum's adverse effect on low cycle fatigue strength in machined articles has never before been appreciated or understood.

It should be understood that the invention is not limited to the particular embodiments shown and described herein. Various changes and modifications in form and detail may be made without departing from the spirit and scope of this novel concept as defined by the following claims.

What is claimed is:

1. A nickel base superalloy article having a tungsten carbide lathe turned machined surface, said superalloy article having enhanced low cycle fatigue strength and consisting essentially of a composition, in weight percent, 2.0–2.4 Al, 4.45–4.75 Ti, 15.0–17.0 Cr, 2.3–3.7 Mo, 12.0–15.0 Co, 0–0.1 W, 0.010–0.020 C, 0.010–0.020 B, 0.030–0.05 Zr, 0.001–0.005 Mg, 0–1.0 Ta, 0–1.0 Nb, 0–2.0 Fe, 0–0.3 Hf, 0–0.02 Y, 0–0.1 V, 0–1.0 Re, balance essentially Ni, said superalloy article having an absence of carbide stringers and further comprising a plurality of discrete MC carbides essentially free from molybdenum for increased fatigue strength, where M is predominantly titanium and C is carbon, wherein the machined surface is not damaged during lathe turning, said article further possessing a high strength of between 200 ksi and 230 ksi at between 1200° F. and room temperature.

2. The article of claim 1 wherein the carbides have a diameter between about 0.0005 inches and about 0.0025 inches. predominantly titanium and C is carbon.

3. The article of claim 1 further including a gamma prime volume fraction percent between about 25 and about 60 percent.

4. The article of claim 1 further including a gamma prime volume fraction percent between about 35 and about 45 percent.

5. A nickel base superalloy article having a tungsten carbide lathe turned machined surface, said superalloy article having enhanced low cycle fatigue strength and consisting essentially of a composition, in weight percent, about 2.2 Al, about 4.6 Ti, about 15.5 Cr, about 3.0 Mo, about 13.5 Co, about 0.015 C, about 0.015 B, about 0.04 Zr, about 0.001 to about 0.005 Mg, balance essentially Ni, said superalloy article having an absence of carbide stringers and further comprising a plurality of discrete MC carbides essentially free from molybdenum for increased fatigue strength, where M is predominantly titanium and C is carbon, wherein the machined surface is not damaged during lathe turning, said article further possessing a high strength of between 200 ksi and 230 ksi at between 1200° F. and room temperature.

6. The article of claim 5, wherein the carbides have a diameter between about 0.0005 inches and about 0.0025 inches.

7. The article of claim 5 further including a gamma prime volume fraction percent between about 25 and about 60 percent.

8. The article of claim 5 further including a gamma prime volume fraction percent between about 35 and about 45 percent.

9. A high strength nickel base superalloy having enhanced low cycle fatigue strength and consisting essentially of, in weight percent, 2.0–2.4 Al, 4.45–4.75 Ti, 15.0–17.0 Cr, 2.3–3.7 Mo, 12.0–15.0 Co, 0–0.1 W, 0.010–0.020 C, 0.010–0.020 B, 0.030–0.050 Zr, 0.001–0.005 Mg, 0–1.0 Ta, 0–1.0 Nb, 0–2.0 Fe, 0–0.3 Hf, 0–0.02 Y, 0–0.1 V, 0–1.0 Re, balance essentially Ni, said superalloy having an absence of carbide stringers and further comprising a plurality of discrete MC carbides essentially free from molybdenum for increased fatigue strength, where M is predominantly titanium and C is carbon.

10. A high strength nickel base superalloy having enhanced low cycle fatigue strength and consisting essentially of, in weight percent, about 2.2 Al, about 4.6 Ti, about 15.5 Cr, about 3.0 Mo, about 13.5 Co, about 0.015 C, about 0.015 B, about 0.04 Zr, about 0.001 to about 0.005 Mg, balance essentially Ni, said superalloy having an absence of carbide stringers and further comprising a plurality of discrete MC carbides essentially free from molybdenum for increased fatigue strength, where M is predominantly titanium and C is carbon.

11. An article having improved low cycle fatigue strength comprising a nickel base superalloy, in weight percent, the following elements: 1.2–3.5 Al; 3.0–7.0 Ti; 12.0–20.0 Cr; 2.0–3.9 Mo; 10.0–20.0 Co; 0–4.5 W; 0.005–0.025 C; 0.005–0.05 B; 0.01–0.1 Zr; 0–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni;

said superalloy (i) being essentially free of molybdenum-containing MC carbides, (ii) being essentially free of MC carbide stringers and (iii) having a plurality of discrete MC carbides, said discrete MC carbides having diameters between about 0.0005 inches and about 0.0025 inches.

12. The article of claim 11, wherein said superalloy comprises, in weight percent, the following elements: 2.0–2.4 Al; 4.45–4.75 Ti; 15.0–17.0 Cr; 2.3–3.7 Mo; 12.0–15.0 Co; 0–0.1 W; 0.010–0.020 C; 0.010–0.020 B; 0.030–0.050 Zr; 0.001–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni.

13. The article of claim 11, wherein said superalloy comprises, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.001–about 0.005 Mg; and balance essentially Ni.

14. The article of claim 11, wherein said superalloy comprises, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.0025 Mg; and balance essentially Ni.

15. The article of claim 11, wherein said superalloy consists essentially of, in weight percent, the following elements: 2.0–2.4 Al; 4.45–4.75 Ti; 15.0–17.0 Cr; 2.3–3.7 Mo; 12.0–15.0 Co; 0–0.1 W; 0.010–0.020 C; 0.010–0.020 B; 0.030–0.050 Zr; 0.001–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni.

16. The article of claim 11, wherein said superalloy consists essentially of, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.001–about 0.005 Mg; and balance essentially Ni.

17. The article of claim 11, wherein said superalloy consists essentially of, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.0025 Mg; and balance essentially Ni.

18. The article of claim 11, wherein said superalloy consists of, in weight percent, the following elements: 2.0–2.4 Al; 4.45–4.75 Ti; 15.0–17.0 Cr; 2.3–3.7 Mo; 12.0–15.0 Co; 0–0.1 W; 0.010–0.020 C; 0.010–0.020 B; 0.030–0.050 Zr; 0.001–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni.

19. The article of claim 11, wherein said superalloy consists of, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.001–about 0.005 Mg; and balance essentially Ni.

20. The article of claim 11, wherein said superalloy consists of, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.0025 Mg; and balance essentially Ni.

21. The article of claim 11, wherein said superalloy has a grain size finer than ASTM grain size 10.

22. The article of claim 11, wherein said superalloy has a grain size finer than ASTM grain size 12.

23. The article of claim 11, wherein the superalloy comprises a volume fraction of gamma prime between 25–60 percent.

24. The article of claim 11, wherein the superalloy comprises a volume fraction of gamma prime between 35–45 percent.

25. The article of claim 11, wherein said article comprises a machined surface produced using a tungsten carbide tool.

26. The article of claim 11, wherein said article is an ingot having a diameter greater than or equal to 24 inches.

27. The article of claim 11, herein said article has at least one dimension greater than or equal to 24 inches.

28. The article of claim 11, wherein said article has an ultimate tensile strength of 200 ksi at 1200° F.

29. A method of making the article of claim 11, comprising the following steps:

(a) casting the nickel base superalloy to form a cast material;

(b) heat treating said cast material to form a heat treated material having improved low cycle fatigue strength; and (c) machining said heat treated material to form said article having a machine surface.

30. The method of claim 29, wherein said machining is performed using a tungsten carbide tool.

31. The method of claim 29, wherein said cast material is an ingot having a diameter greater than or equal to twenty four inches.

32. The method of claim 29, wherein said article has at least one dimension greater than or equal to twenty four inches.

33. The method of claim 29, wherein said article has an ultimate tensile strength of 200 ksi at 1200° F.

34. The method of claim 29, wherein said nickel base superalloy comprises, in weight percent, the following elements: 2.0–2.4 Al; 4.45–4.75 Ti; 15.0–17.0 Cr; 2.3–3.7 Mo; 12.0–15.0 Co; 0–0.1 W; 0.010–0.020 C; 0.010–0.020 B; 0.030–0.050 Zr; 0.001–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni.

35. A method of making a nickel base superalloy having improved low cycle fatigue strength, said method comprising the steps of:

(a) casting a nickel base superalloy composition to form a cast material, said nickel base superalloy composition comprising, in weight percent, the following elements: 1.2–3.5 Al; 3.0–7.0 Ti; 12.0–20.0 Cr; 2.0–3.9 Mo; 10.0–20.0 Co; 0–4.5 W; 0.005–0.025 C; 0.005–0.05 B; 0.01–0.1 Zr; 0–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni;

(b) heat treating said cast material to form a heat treated nickel base superalloy having improved low cycle fatigue strength, said heat treated nickel base superalloy (i) being essentially free of molybdenum-containing MC carbides, (ii) being essentially free of MC carbide stringers and (iii)

having a plurality of discrete MC carbides, said discrete MC carbides having diameters between about 0.0005 inches and about 0.0025 inches.

36. The method of claim 35, wherein said cast material is an ingot having a diameter greater than or equal to twenty four inches.

37. The method of claim 35, wherein said heat treated nickel base superalloy has an ultimate tensile strength of 200 ksi at 1200° F.

38. The method of claim 35, wherein said superalloy composition comprises, in weight percent, the following elements: 2.0–2.4 Al; 4.45–4.75 Ti; 15.0–17.0 Cr; 2.3–3.7 Mo; 12.0–15.0 Co; 0–0.1 W; 0.010–0.020 C; 0.010–0.020 B; 0.030–0.050 Zr; 0.001–0.005 Mg; 0–1.0 Ta; 0–1.0 Nb; 0–2.0 Fe; 0–0.3 Hf; 0–0.02 Y; 0–0.1 V; 0–1.0 Re; and balance essentially Ni.

39. The method of claim 35, wherein said superalloy composition comprises, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.001– about 0.005 Mg; and balance essentially Ni.

40. The method of claim 35, wherein said superalloy composition comprises, in weight percent, the following elements: about 2.2 Al; about 4.6 Ti; about 15.5 Cr; about 3.0 Mo; about 13.5 Co; about 0.015 C; about 0.015 B; about 0.04 Zr; about 0.0025 Mg; and balance essentially Ni.

* * * * *

UNITED STATES PATENT AND TRADEMARK OFFICE

CERTIFICATE OF CORRECTION

PATENT NO : 5,938,863

DATED : August 17, 1999

INVENTOR(S) : David R. Malley

It is certified that error appears in the above-identified patent and that said Letters Patent is hereby corrected as shown below:

Claim 2, line 3, delete "predominantly titanium and C is carbon".

Claim 27, line 1, change "herein" to -- wherein --.

Signed and Sealed this

Seventh Day of March, 2000

*Attest:*

*Attesting Officer*

Q. TODD DICKINSON

*Commissioner of Patents and Trademarks*